US007292192B2

(12) United States Patent
Aritake

(10) Patent No.: US 7,292,192 B2
(45) Date of Patent: Nov. 6, 2007

(54) ANTENNA SYSTEM AND PORTABLE TERMINAL HAVING THE ANTENNA SYSTEM

(75) Inventor: Sota Aritake, Kawasaki (JP)

(73) Assignee: Kyocera Corporation, Kyoto (JP)

( * ) Notice: Subject to any disclaimer, the term of this patent is extended or adjusted under 35 U.S.C. 154(b) by 52 days.

(21) Appl. No.: 11/221,543

(22) Filed: Sep. 7, 2005

(65) Prior Publication Data

US 2006/0066492 A1 Mar. 30, 2006

(30) Foreign Application Priority Data

Sep. 27, 2004 (JP) ..... 2004-279951

(51) Int. Cl.
*H01Q 1/24* (2006.01)

(52) U.S. Cl. ..... 343/702; 343/729; 455/575.7

(58) Field of Classification Search ..... 343/702, 343/725, 729, 895; 455/575.7
See application file for complete search history.

(56) References Cited

U.S. PATENT DOCUMENTS 4,958,382 A * 9/1990 Imanishi ..... 455/277.1

FOREIGN PATENT DOCUMENTS

JP 2003-318770 11/2003

* cited by examiner

*Primary Examiner*—Michael C. Wimer
(74) *Attorney, Agent, or Firm*—Hogan & Hartson LLP

(57) ABSTRACT

An antenna system mounted in a portable terminal has a main antenna for transmitting and receiving a radio wave signal, wherein the main antenna is contained in a body of the portable terminal in a first mode of the portable terminal and is pulled out from a body of the portable terminal in a second mode of the portable terminal; and a sub-antenna for performing diversity reception of a radio wave signal, wherein when a state of the main antenna is switched depending on whether the portable terminal is in the first mode or the second mode, constitution of the main antenna and constitution of the sub-antenna are varied so that directivities of the main antenna and the sub-antenna compensate each other. Typically, the main antenna is a whip antenna having a helical antenna and a linear antenna, and a sub-antenna element is provided.

3 Claims, 4 Drawing Sheets

ANTENNA SYSTEM AND PORTABLE TERMINAL HAVING THE ANTENNA SYSTEM

BACKGROUND OF THE INVENTION

1. Field of the Invention

The present invention relates to an antenna system for performing diversity transmission and reception, and relates to a portable terminal having the antenna system.

Priority is claimed on Japanese Patent Application No. 2004-279951, filed Sep. 27, 2004, the content of which is incorporated herein by reference.

2. Description of the Related Art

FIGS. 3A and 3B show a structure of a conventional antenna system for performing diversity transmission and reception, which is mounted in a portable terminal (see Reference 1: Japanese Unexamined Patent Application, First Publication No. 2003-318770).

FIG. 3A shows a state in which a main antenna 2 is contained in a body 1 of a portable terminal, and FIG. 3B shows a state in which the main antenna 2 is pulled out of the body 1 of the portable terminal. In FIGS. 3A and 3B, the antenna system has the main antenna 2 and a sub-antenna 3, so as to perform diversity reception.

The main antenna 2 includes a helical antenna 20 and a linear antenna 23, which constitute a whip antenna. The helical antenna 20 is provided at the head of the main antenna 2 and is surrounded by an insulating material 21. An end of a coil of which the helical antenna 20 is made is connected to a terminal 22.

The linear antenna 23 is surrounded by an insulating material 24, and an end of the linear antenna 23 is connected to a terminal 25.

The body 1 of the portable terminal contains a power supply 100 for supplying electric power to the main antenna 2, a bandpass filter 101 for passing a transmitting or receiving signal of a desired frequency, a switch 102, the above sub-antenna 3, and a bandpass filter 103 for passing a transmitting or receiving signal of a desired frequency.

The power supply 100 is connected via the filter 101 to the switch 102. According to the movement of the main antenna 2, the power supply 100 can be positioned where the power supply 100 contacts the terminal 22 or 25.

The sub-antenna 3, which is a dipole antenna, has a coil wound around an insulating body, and electric power is supplied to a center point of the coil. The center point for supplying electric power is connected via the filter 103 to the switch 102. In contrast with the main antenna 2, the sub-antenna 3 is fixed in the body 1 so that the constitution of the sub-antenna is not changed even when the main antenna 2 is pulled out or contained.

In the above structure, when the main antenna 2 is pushed into the body 1 of the portable terminal and is contained in the body 1 (see FIG. 3A), the terminal 22 of the main antenna 2 contacts the power supply 100, so that the power supply 100 and an end of the helical antenna 20 are connected to each other.

Accordingly, only the portion indicated by the double-headed arrow "a", that is, only the helical antenna 20 functions as the main antenna. FIG. 4A shows a directional pattern of the antenna in this state. In FIG. 4A, the ordinary solid line shows a directional pattern of the main antenna, and the bold solid line shows a directional pattern of the sub-antenna. As clearly shown in FIG. 4A, the area having low directivity in the main antenna is covered or compensated for by the directivity of the sub-antenna.

In contrast, when the main antenna 2 is pulled out from the body 1 of the portable terminal (see FIG. 3B), the terminal 25 of the main antenna 2 contacts the power supply 100, so that the power supply 100 and an end of the linear antenna 23 are connected to each other.

Accordingly, only the portion indicated by the double-headed arrow "b", that is, only the linear antenna 23 functions as the main antenna. FIG. 4B shows a directional pattern of the antenna in this state. In FIG. 4B, the ordinary solid line shows a directional pattern of the main antenna, and the bold solid line shows a directional pattern of the sub-antenna. In this case, as the main antenna is switched from the helical antenna 20 to the linear antenna 23, directivity of the main antenna is improved, and an improved directional pattern of the main antenna substantially covers the directional pattern of the sub-antenna.

In the above antenna system as described in Reference 1, the sub-antenna is fixed in the body of the portable terminal. Therefore, when the main antenna is pulled out or contained, that is, when the main antenna is pulled out from the body of the portable terminal or contained in the body, the directional pattern of the main antenna changes while the directional pattern of the sub-antenna cannot be changed.

SUMMARY OF THE INVENTION

In light of the above circumstances, an object of the present invention is to provide an antenna system, by which when the main antenna is pulled out or contained, directivities of the main antenna and the sub-antenna can be changed in a manner such that both directivities complement each other, without providing a specific switching device.

Therefore, the present invention provides an antenna system mounted in a portable terminal, comprising:

a main antenna for transmitting and receiving a radio wave signal, wherein the main antenna is contained in a body of the portable terminal in a first mode of the portable terminal and is pulled out from a body of the portable terminal in a second mode of the portable terminal; and a sub-antenna for performing diversity reception of a radio wave signal, wherein when a state of the main antenna is switched depending on whether the portable terminal is in the first mode or the second mode, constitution of the main antenna and constitution of the sub-antenna are varied so that directivities of the main antenna and the sub-antenna compensate each other.

Preferably, the antenna system may further comprise:

a first power supply for supplying electric power to the main antenna; and a second power supply for supplying electric power to the sub-antenna, wherein:

the main antenna is a whip antenna having a helical antenna and a linear antenna;

a sub-antenna element as an element of the sub antenna is provided, which always contacts the second power supply:

when the portable terminal is in the first mode, only the helical antenna is connected as the main antenna to the first power supply, and the linear antenna is connected to the second power supply so that the linear antenna and the sub-antenna element constitute a dipole antenna forming the sub-antenna; and when the portable terminal is in the second mode, only the linear antenna is connected as the main antenna to the first power supply, and only the sub-antenna element is connected as the sub-antenna to the second power supply.

In a typical example, the constitution of the main antenna and the constitution of the sub-antenna are varied so that in a directional pattern, an area having a lower directivity of one of the main antenna and the sub-antenna is compensated for by a directivity of the other antenna in either of the first and the second modes.

According to the antenna system of the present invention, directivities of the main antenna and the sub-antenna can be changed in a manner such that both directivities complement each other, by only performing extension or retraction of the main antenna, without providing a specific switching device.

The present invention also provides a portable terminal in which an antenna system as described above is mounted. According to the portable terminal, performance of diversity transmission and reception can be improved.

DETAILED DESCRIPTION OF THE INVENTION

Hereinafter, embodiments according to the present invention will be described with reference to the appended figures.

Figure 1A:
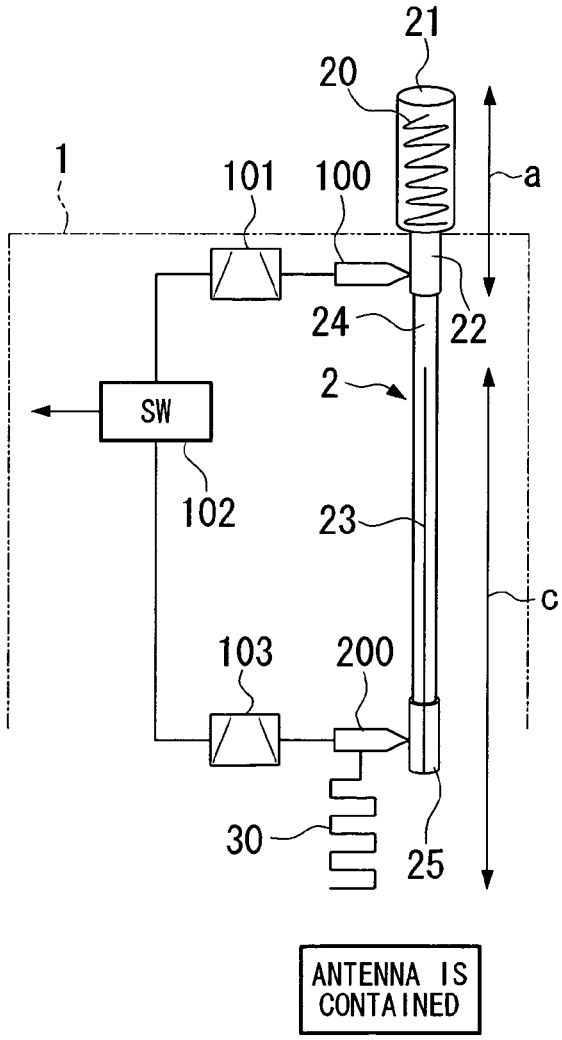
FIGS. 1A and 1B show a structure of an antenna system as an embodiment of the present invention.
Figure 1B:
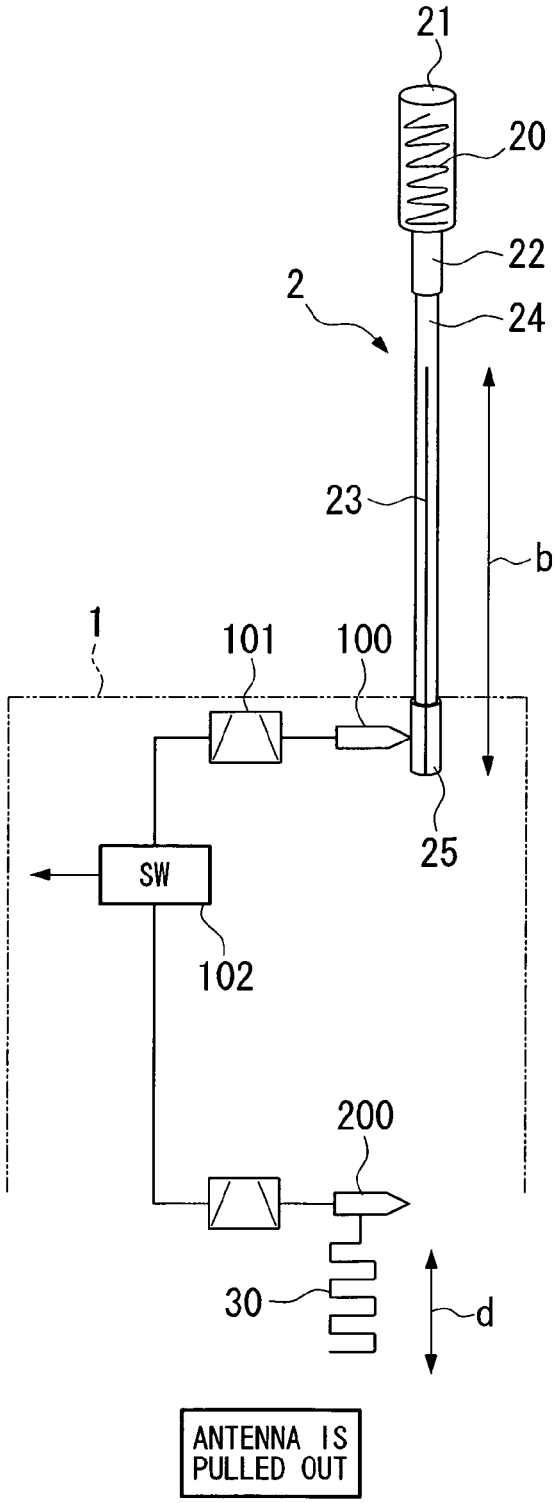
Figure 3A:
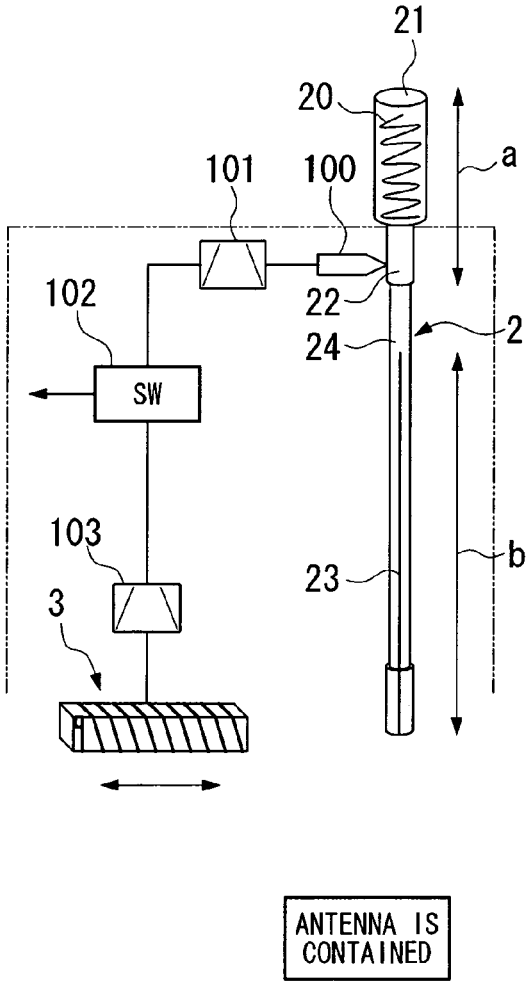
FIGS. 3A and 3B show a structure of a conventional antenna system.
Figure 3B:
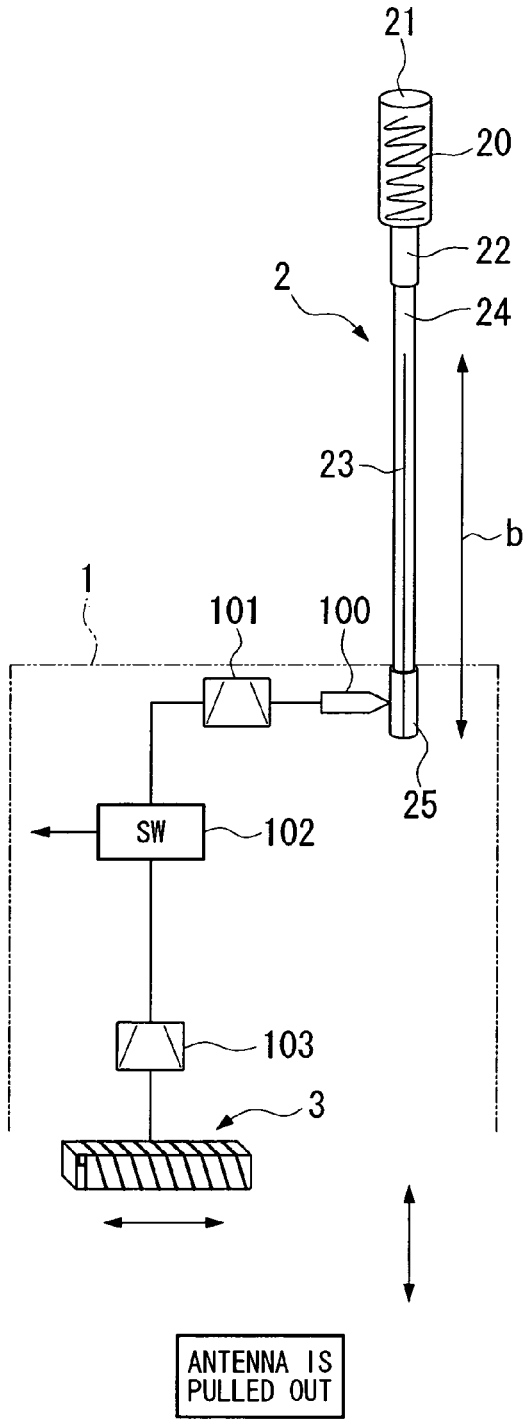

FIGS. 1A and 1B show a structure of an antenna system as an embodiment of the present invention. In FIGS. 1A and 1B, the antenna system is mounted in a portable terminal, and has a main antenna 2 for transmitting and receiving a radio wave signal, and a sub-antenna element 30 for performing diversity transmission and reception of a radio wave signal. In FIGS. 1A and 1B, parts identical to those in FIGS. 3A and 3B are given identical reference numerals.

In FIGS. 1A and 1B, the antenna system of the present invention has a first power supply 100 for supplying electric power to the main antenna 2, and a second power supply 200 for supplying electric power to the sub-antenna element 30.

According to the movement of the main antenna 2, the first power supply 100 can be positioned where the power supply 100 contacts a terminal 22 or 25, and the second power supply 200 can be positioned where the power supply 200 contacts the terminal 25.

The main antenna 2 is a whip antenna consisting of a helical antenna 20 which is surrounded by an insulating material 21, and a linear antenna 23. The sub-antenna element 30 always contacts the second power supply 200 and has a fixed length. This sub-antenna element 30 is formed on a substrate (not shown) which is fixed in the body 1 of the portable terminal.

An end of the coil of which the helical antenna 20 is made is connected to the terminal 22. In addition, the linear antenna 23 is surrounded by an insulating material 24, and an end of the linear antenna 23 is connected to the terminal 25.

The first power supply 100 is connected to a switch (SW) 102 via a bandpass filter 101 for passing a transmitting or receiving signal having a desired frequency. The second power supply 200 is connected to the switch 102 via a bandpass filter 103 for passing a transmitting or receiving signal having a desired frequency.

The switch 102 is connected to a transmitting and receiving section (not shown) and is provided for switching the antenna to the main antenna or the sub-antenna when performing diversity transmission and reception, and performing the transmission or reception using the transmitting and receiving section.

Figure 2A:
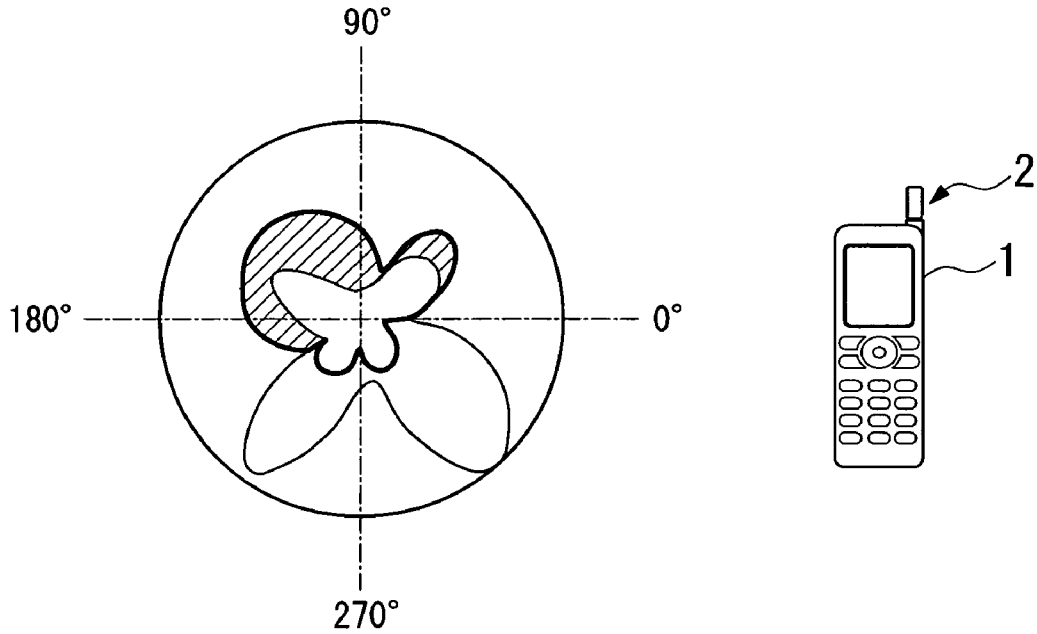
FIGS. 2A and 2B show directional patterns of the antenna in the embodiment.

In the above structure, when the main antenna 2 is pushed into the body 1 of the portable terminal and is contained in the body 1 (see FIG. 1A), (i) the terminal 22 of the main antenna 2 contacts the first power supply 100, so that the first power supply 100 and an end of the helical antenna 20 are connected to each other, and (ii) the terminal 25 of the main antenna 2 contacts the second power supply 200, so that the second power supply 200 and an end of the linear antenna 23 are connected to each other Accordingly, only the helical antenna 20 (indicated by the double-headed arrow "a") functions as the main antenna, and the linear antenna 23 and the sub-antenna element 30 constitute a dipole antenna (see the double-headed arrow c). This dipole antenna functions as the sub-antenna. FIG. 2A shows a directional pattern of the antenna in this state. In FIG. 2A, the ordinary solid line shows a directional pattern of the main antenna, and the bold solid line shows a directional pattern of the sub-antenna. As clearly shown in FIG. 2A, the area having low directivity in the main antenna is covered or compensated for by the directivity of the sub-antenna.

In contrast, when the main antenna 2 is pulled out from the body 1 of the portable terminal (see FIG. 1B), (i) the terminal 25 of the main antenna 2 contacts the first power supply 100, so that the first power supply 100 and an end of the linear antenna 23 are connected to each other, and (ii) only the sub-antenna element 30 is connected to the second power supply 200. Accordingly, only the linear antenna 23 (indicated by the double-headed arrow "b") functions as the main antenna, and only the sub-antenna element 30 functions as the sub-antenna (see the double-headed arrow c).

Figure 2B:
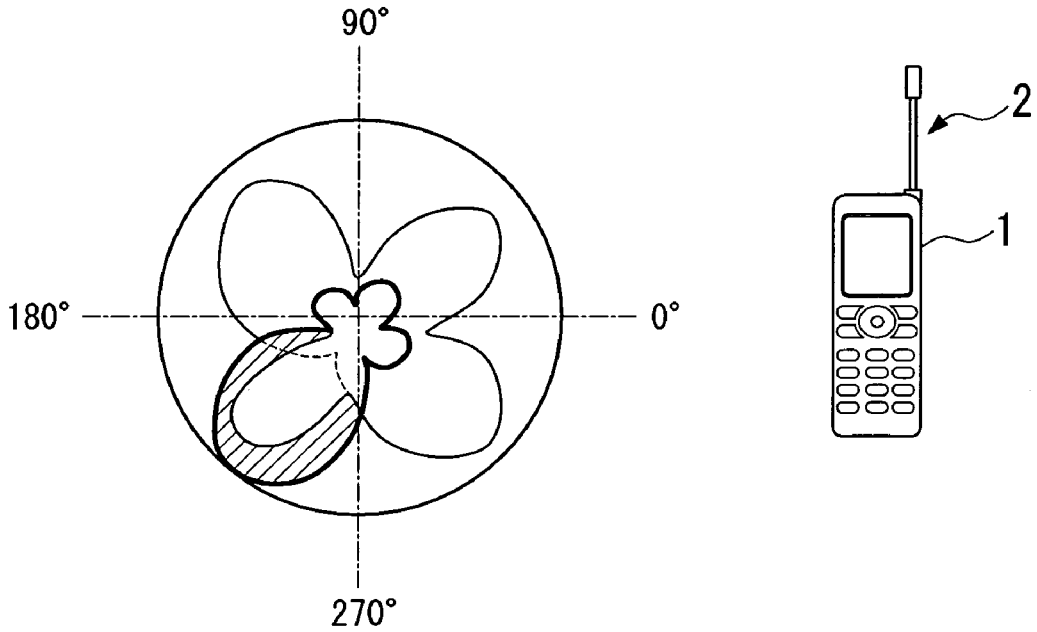
Figure 4A:
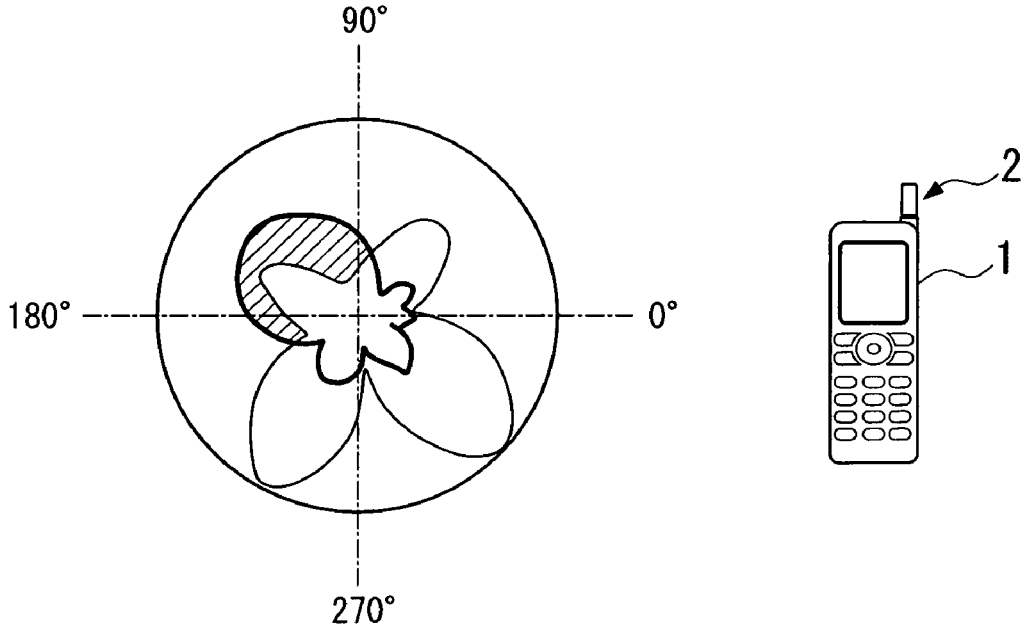
FIGS. 4A and 4B show directional patterns of the conventional antenna system in FIGS. 3A and 3B.
Figure 4B:
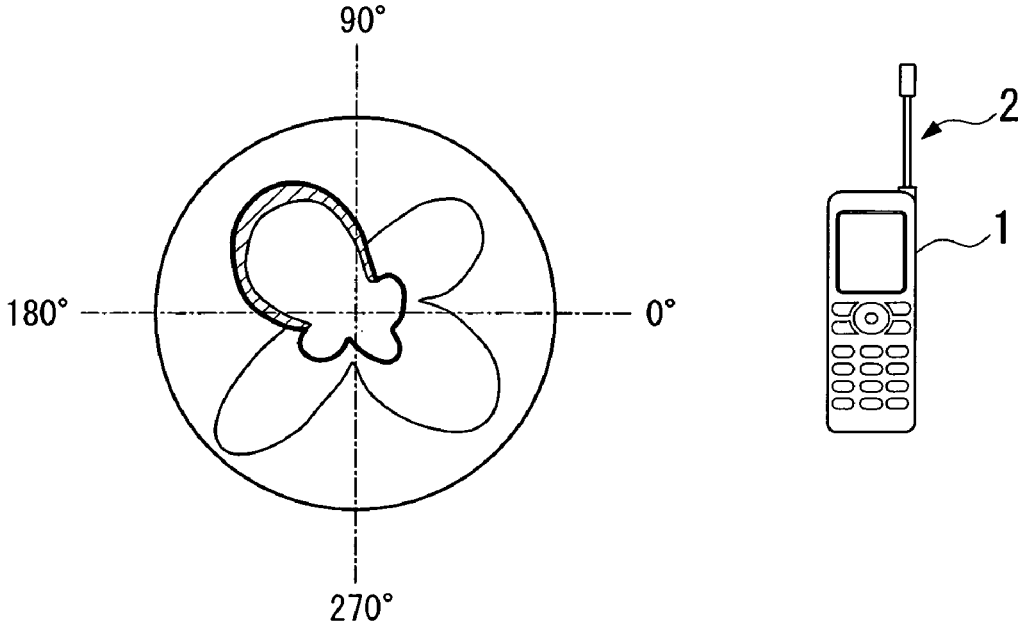

FIG. 2B shows a directional pattern of the antenna in this state. In FIG. 2B, the ordinary solid line shows a directional pattern of the main antenna, and the bold solid line shows a directional pattern of the sub-antenna. In the present embodiment, the constitution of each of the main antenna and the sub-antenna is switched or varied when the main antenna 2 is pulled out from the body 1. Therefore, the directivity of each of the main antenna and the sub-antenna is also switched. Accordingly, in comparison with a conventional system in which the constitution of the sub-antenna is not switched and the directional pattern of the sub-antenna overlaps the directional pattern of the main antenna (see FIG. 4B), the directional pattern of the sub-antenna can be distributed in an area where the directivity of the main antenna is low. Such a distribution can be predetermined. Therefore, in the present embodiment, effects in diversity transmission and reception by using the sub-antenna can be improved.

When an antenna system as described in the above embodiment is mounted in a portable terminal, performance of diversity transmission and reception can be improved.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. An antenna system mounted in a portable terminal, comprising:

a main antenna for transmitting and receiving a radio wave signal, wherein the main antenna is contained in a body of the portable terminal in a first mode of the portable terminal and is pulled out from a body of the portable terminal in a second mode of the portable terminal;

a sub-antenna for performing diversity reception of a radio wave signal, wherein when a state of the main antenna is switched depending on whether the portable terminal is in the first mode or the second mode, constitution of the main antenna and constitution of the sub-antenna are varied so that directivities of the main antenna and the sub-antenna compensate each other;

a first power supply for supplying electric power to the main antenna; and a second power supply for supplying electric power to the sub-antenna, wherein:

the main antenna is a whip antenna having a helical antenna and a linear antenna;

a sub-antenna element as an element of the sub antenna is provided, which always contacts the second power supply;

when the portable terminal is in the first mode, only the helical antenna is connected as the main antenna to the first power supply, and the linear antenna is connected to the second power supply so that the linear antenna and the sub-antenna element constitute a dipole antenna forming the sub-antenna; and when the portable terminal is in the second mode, only the linear antenna is connected as the main antenna to the first power supply, and only the sub-antenna element is connected as the sub-antenna to the second power supply.

2. The antenna system as claimed in claim 1, wherein the constitution of the main antenna and the constitution of the sub-antenna are varied so that in a directional pattern, an area having a lower directivity of one of the main antenna and the sub-antenna is compensated for by a directivity of the other antenna in either of the first and the second modes.

3. A portable terminal in which an antenna system as claimed in claim 1 is mounted.

* * * * *